US005285195A

United States Patent [19]

Way et al.

[11] Patent Number: 5,285,195

[45] Date of Patent: Feb. 8, 1994

[54] ELECTRIC FENCE MONITORING APPARATUS INDICATING ELECTRICAL ENERGIZATION

[76] Inventors: George D. Way; Kathy L. Way, both of 850 Anne Rd., Windsor, N.Y. 13865

[21] Appl. No.: 962,904

[22] Filed: Oct. 19, 1992

[51] Int. Cl.[5] ..... G08B 21/00

[52] U.S. Cl. ..... 340/654; 340/660; 340/635; 324/133; 256/10

[58] Field of Search ..... 340/564, 654, 657, 660, 340/635, 650; 324/133; 256/10

[56] References Cited

U.S. PATENT DOCUMENTS 4,220,949 9/1980 Pope et al. ..... 340/650

4,725,825 2/1988 McKean ..... 340/660

*Primary Examiner*—Jeffrey Hofsass

*Attorney, Agent, or Firm*—Leon Gilden

[57] ABSTRACT

In cooperation with an electric fence, a grounding rod directed into a ground supporting surface includes electrical communication with a fluorescent tubular light, with the tubular light having an upper distal end and electrical contact structure, to include a clip member for securement to an electrical fence in cooperation therewith to indicate electrical operability of the fence and its activation.

4 Claims, 3 Drawing Sheets

ELECTRIC FENCE MONITORING APPARATUS INDICATING ELECTRICAL ENERGIZATION

BACKGROUND OF THE INVENTION

1. Field of the Invention

The field of invention relates to electrical fence apparatus, and more particularly pertains to a new and improved electric fence monitoring apparatus wherein the same is arranged to indicate electrical energizing of an electrical fence.

2. Description of the Prior Art

Conventional monitoring of electrical fence structure for use in agricultural and animal husbandry environments is complicated by the need to monitor such fence structure to insure that the fence is operative and not in disrepair. Prior art structure such as indicated in U.S. Pat. No. 4,220,949 and 4,725,825 indicate prior art electric fence monitoring structure for indicating electric fence charge directed therethrough.

The instant invention provides for a simplified, easily mounted monitoring structure in a manner not addressed by the prior art permitting its ease of mounting and removal relative to electric fence structure to indicate operation of the electric fence in a convenient and effective manner.

SUMMARY OF THE INVENTION

In view of the foregoing disadvantages inherent in the known types of electric fence monitoring apparatus now present in the prior art, the present invention provides an electric fence monitoring apparatus wherein a fluorescent light is arranged to include a first end grounded and a second end for selective ease of securement to an electric fence wire to indicate effectiveness of the electric fence upon illumination of the light member. As such, the general purpose of the present invention, which will be described subsequently in greater detail, is to provide a new and improved electric fence monitoring apparatus which has all the advantages of the prior art electric fence monitoring apparatus and none of the disadvantages.

To attain this, the present invention provides, in cooperation with an electric fence, a grounding rod directed into a ground supporting surface, including electrical communication with a fluorescent tubular light, with the tubular light having an upper distal end and electrical contact structure, to include a clip member for securement to an electrical fence in cooperation therewithin to indicate electrical operability of the fence and its activation.

My invention resides not in any one of these features per se, but rather in the particular combination of all of them herein disclosed and claimed and it is distinguished from the prior art in this particular combination of all of its structures for the functions specified.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto. Those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new and improved electric fence monitoring apparatus which has all the advantages of the prior art electric fence monitoring apparatus and none of the disadvantages.

It is another object of the present invention to provide a new and improved electric fence monitoring apparatus which may be easily and efficiently manufactured and marketed.

It is a further object of the present invention to provide a new and improved electric fence monitoring apparatus which is of a durable and reliable construction.

An even further object of the present invention is to provide a new and improved electric fence monitoring apparatus which is susceptible of a low cost of manufacture with regard to both materials and labor, and which accordingly is then susceptible of low prices of sale to the consuming public, thereby making such electric fence monitoring apparatus economically available to the buying public.

Still yet another object of the present invention is to provide a new and improved electric fence monitoring apparatus which provides in the apparatuses and methods of the prior art some of the advantages thereof, while simultaneously overcoming some of the disadvantages normally associated therewith.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figures 1, 2:
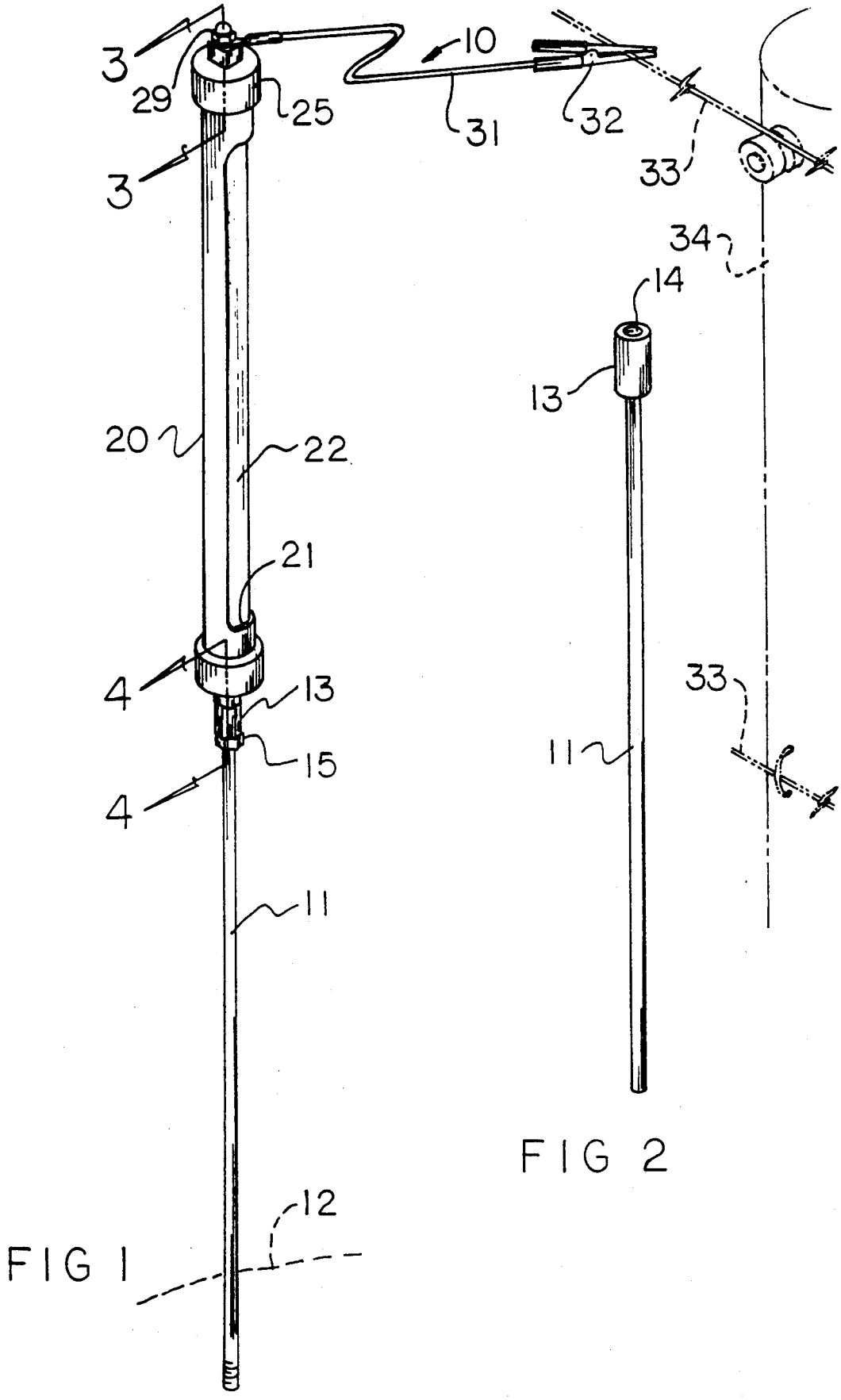
FIG. 1 is an isometric illustration of the instant invention.
FIG. 2 is an isometric illustration of the grounding rod structure of the invention.
Figure 3:
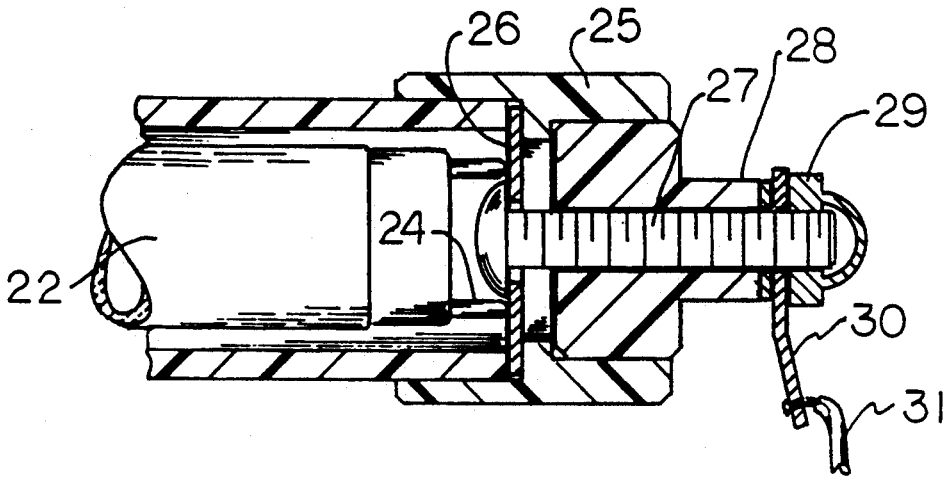
FIG. 3 is an orthographic view, taken along the lines 3—3 of FIG. 1 in the direction indicated by the arrows.

With reference now to the drawings, and in particular to FIGS. 1 to 6 thereof, a new and improved electric fence monitoring apparatus embodying the principles and concepts of the present invention and generally designated by the reference numeral 10 will be described.

Figure 4:
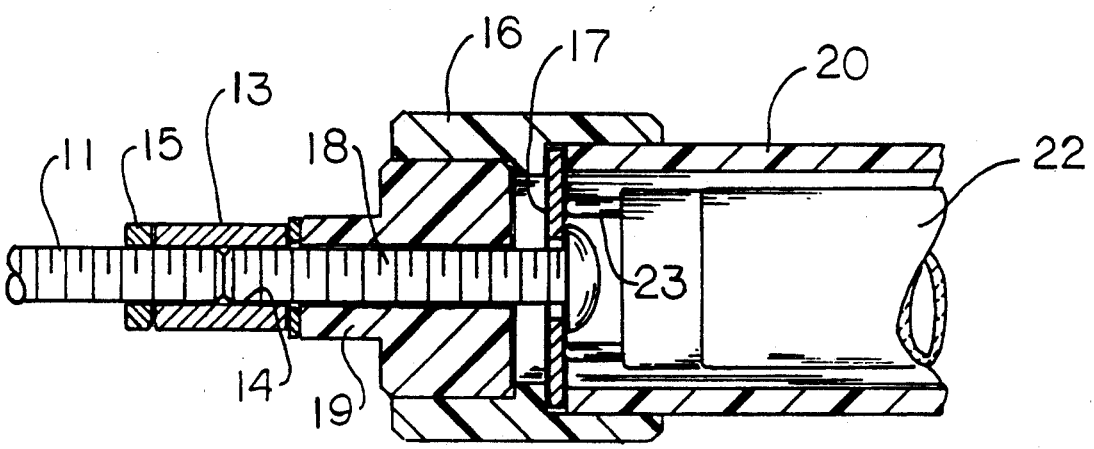
FIG. 4 is an orthographic view, taken along the lines 4—4 of FIG. 1 in the direction indicated by the arrows.

More specifically, the electric fence monitoring apparatus 10 of the instant invention essentially comprises an elongate grounding rod 11 arranged for projection into a ground surface that simultaneously receives the fence post structure 34 of an electric fence having at least one electric fence line 33. A coupler assembly 13 is threadedly mounted to an upper distal end of the grounding rod 11, with the coupler assembly 13 having an internally threaded bore 14. A lock fastener 15 engages the grounding rod 11 and a coupler assembly lower end, in a manner as indicated in FIG. 4, to fixedly secure the coupler assembly 13 relative to the grounding rod 11. A first support sleeve 16 is provided, including a metallic first electric contact plate 17 oriented orthogonally relative to the grounding rod 11. A first electrical conductive plate rod 18 is directed through the first contact plate 17 and through a first insulative plug member 19 mounted within the first sleeve 16 between the first plate 17 and the coupler assembly 13. As indicated, the first plate rod 18 is threadedly directed into the coupler assembly 13 coaxially aligned with the grounding rod 11. A transparent position tube 20 extends from the first support sleeve 16 to a second support sleeve 25 in a spaced relationship. The transparent position tube 20 includes, if desired, a window opening 21 therethrough. A fluorescent tube light 22 includes a first electrical contact 23 in electrical communication with the first electrical contact plate 17 and oriented coaxially aligned with the grounding rod 11 within the transparent position tube 20. A second electrical contact 24 at an upper distal end of the fluorescent tube light 22 spaced from the lower distal end of the fluorescent tube light is oriented within the second support sleeve 25 having a second electrical plate 26, with the second sleeve 25 including a second plug member 28, and a second plate rod 27 directed through the second electrical plate 26 and through the insulative second plug member 28 secured to an electrical strip 30, with a fastener cap 29 mounted to the second plate rod 27 to secure the electrical strip 30 fixedly to the second plate rod 27. An electrical cable 31 is directed from the electrical strip 30 and terminates in a clamp 32, with the clamp 32 arranged for securement to the electric fence line 33. In this manner, upon proper electrical energy directed through the electrical fence line 33, electrical energy is directed through the fluorescent light 22 for its illumination for indication of proper activation of the electric fence structure.

Figures 5, 6:
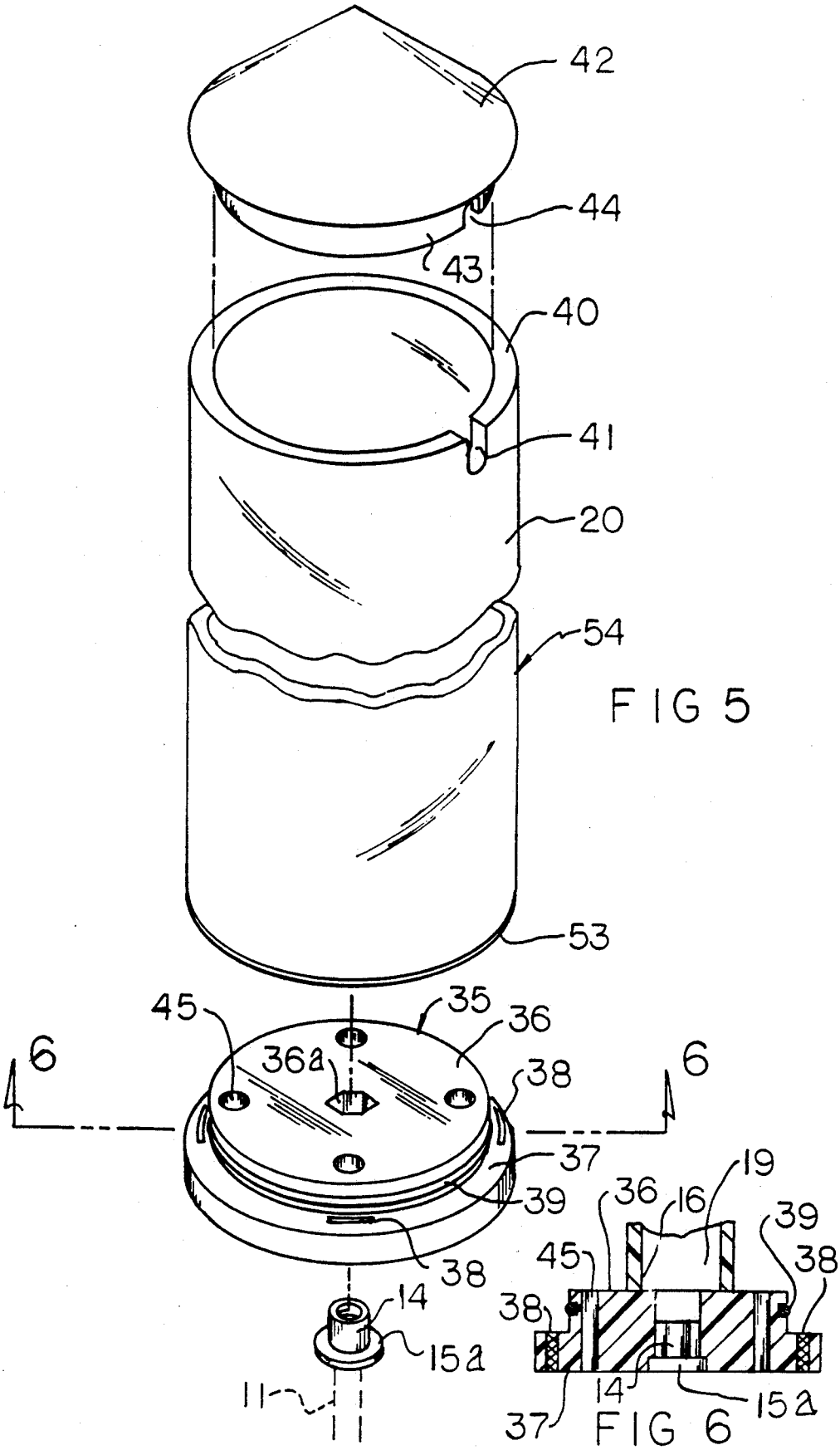
FIG. 5 is an isometric illustration in an exploded view of an enclosure for the illumination structure of the invention.
FIG. 6 is an orthographic view, taken along the lines 6—6 of FIG. 5 in the direction indicated by the arrows.

FIG. 5 indicates the use of an enclosure during periods of severe weather to provide for sealingly enclosing the organization for its weatherproofing, and more specifically to enclose the organization extending from the first support sleeve 16 to include the second support sleeve 25. To this end, a lower cap 35 is provided to receive the first support sleeve 16 and the first plug member 19 onto a top surface of a lower cap boss 36. The lower cap boss 36 includes a plurality of drainage apertures 35 directed through-extending the cap 35. The cap 35 is further formed with a flange plate 37 extending diametrically beyond the boss 36 having a plurality of ferromagnetic members 38 positioned therewithin. The boss 36 includes a boss bore 36*a* as indicated coaxially of the cap 35 to receive the coupler assembly 13 therethrough, as well as proper orienting the first plug member 19 and receiving a lower end of the first plug member within the boss bore 36*a*, as illustrated in FIG. 6. A sealing ring 39 is secured circumferentially about the lower cap boss 36 above the flange plate 37. A transparent cover tube 54 is provided for surroundingly protecting the fluorescent light and positioning tube structure of FIG. 1. The cover tube 54 includes a ferrous ring 53 at its lower distal end for securement to the lower cap boss 36 to sealingly engage the sealing ring 39 with the ferrous ring 53 in engagement with the magnetic members 38 to properly orient the cover tube relative to the lower cap 35. The cover tube 54 includes a cover tube upper distal end 40, having a slot 41 directed thereon to receive the electrical strip 30 and the electrical cable 31 therethrough. A position tube upper cap 41 is provided received within the upper distal end of the tube, with the upper cap 42 having a cap skirt 43 frictionally engaged within the upper distal end 40, with the cap skirt 43 having a skirt slot 44 arranged for alignment with the slot 41. It should be noted that the drain bores 45 are provided through the lower cap boss 36, the lower cap 35, to insure ventilation and proper drainage within the cover tube 54 in the event of moisture being directed within the cover tube 54 during inclement weather.

As to the manner of usage and operation of the instant invention, the same should be apparent from the above disclosure, and accordingly no further discussion relative to the manner of usage and operation of the instant invention shall be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by LETTERS PATENT of the United States is as follows:

1. An electrical fence monitoring apparatus, comprising, an elongate grounding rod of electrically conducting material having a rod first end for projection within a grounding surface, and a rod second end, the rod second end including a coupler assembly mounted thereto, and fastener means mounted to the grounding rod in contiguous communication with the coupler assembly for fixedly positioning the coupler assembly relative to the grounding rod, and the coupler assembly including a first insulative plug member mounted in contiguous communication with the coupler assembly coaxially aligned with the coupler assembly and the grounding rod, and the first plug member including a first sleeve receiving the plug member in a spaced relationship relative to the coupler assembly, and the sleeve having a first electrically conductive contact plate positioned within the sleeve in adjacency to the first plug member, with the first contact plate orthogonally oriented relative to the grounding rod, and a first electrically conductive plate rod extending through the first electrical contact plate to effect electrical communication between the first electrical contact plate and the coupler assembly as the first plate rod is received within the coupler assembly extending through the first plug member, and a fluorescent tube light having a tube light first end in contiguous communication with the first contact plate, and a tube second end spaced from the tube first end, and a second sleeve, the second sleeve having a second electrically conductive contact plate, wherein the second contact plate is in contiguous communication with the tube light second end, and a second plug member positioned within the second sleeve, and a second plate rod in electrical communication with the second contact plate, the second plate rod extending through the second plug member coaxially aligned relative to the tube light and the grounding rod, and an electrical contact strip mounted to the second plate rod exteriorly of the second sleeve, and a fastener cap mounted to the second plate rod, with the contact strip oriented between the fastener cap and the second plug member, and an electrical cable in electrical communication with the contact strip, with the electrical cable having a cable free end spaced from the contact strip, and a cable clamp attached to said free end, the cable clamp arranged for securement to an electrical fence line.

2. An apparatus as set forth in claim 1 including a transparent position tube, with the position tube having a position tube first end positioned within the first sleeve, and a position tube second end, the position tube second end positioned within the second sleeve, the position tube coextensive with the tube light, with the tube light positioned within the position tube.

3. An apparatus as set forth in claim 2 including a lower cap, the lower cap having a flange plate and a boss, with the boss positioned medially of the flange plate and the boss having a boss bore directed through the boss and the flange plate coaxially aligned relative to the lower cap, and the boss bore arranged for receiving a coupler assembly therethrough, and ferromagnetic members mounted within the flange plate exteriorly of the boss, and a sealing ring mounted circumferentially about the boss, and a transparent cover tube, the transparent cover tube having a tube lower distal end, the tube lower distal end including a ferrous ring, the ferrous ring arranged for magnetic adherence to the ferromagnetic members, and the cover tube receiving the position tube therewithin, and the cover tube having a cover tube upper distal end, the tube upper distal end having a slot and an upper cap, the upper cap having an upper cap skirt received within the tube upper distal end, the skirt having a skirt slot aligned with the slot, with the electrical cable directed through the skirt slot and the slot.

4. An apparatus as set forth in claim 3 further including a plurality of drainage bores directed through the boss within the cover tube.

* * * * *